US007448629B2

(12) United States Patent
Robinson

(10) Patent No.: US 7,448,629 B2
(45) Date of Patent: Nov. 11, 2008

(54) TRI BOARD GAME

(76) Inventor: Anthony Rollando Robinson, 3506 Saville La., Mitchellville, MD (US) 20721

( * ) Notice: Subject to any disclaimer, the term of this patent is extended or adjusted under 35 U.S.C. 154(b) by 46 days.

(21) Appl. No.: 11/206,758

(22) Filed: Aug. 19, 2005

(65) Prior Publication Data

US 2007/0040330 A1 Feb. 22, 2007

(51) Int. Cl.
*A63F 3/00* (2006.01)

(52) U.S. Cl. ..... 273/261; 273/242

(58) Field of Classification Search ..... 273/260, 273/261, 242; D21/348, 349, 365
See application file for complete search history.

(56) References Cited

U.S. PATENT DOCUMENTS 440,737 A * 11/1890 Burge ..... 273/258
2,273,009 A 2/1942 Fisher
2,743,107 A 4/1956 Hollossy
3,342,493 A * 9/1967 Lang ..... 273/271
3,794,326 A 2/1974 Bialek
3,977,677 A 8/1976 Magiera
4,093,237 A * 6/1978 Weiss ..... 273/260
4,813,679 A 3/1989 Hoffman
4,976,437 A * 12/1990 Berard ..... 273/261
5,570,887 A 11/1996 Christie, Jr.
5,692,752 A 12/1997 Hanna
5,876,034 A * 3/1999 Stafford ..... 273/244

* cited by examiner

*Primary Examiner*—Vishu K. Mendiratta
(74) *Attorney, Agent, or Firm*—Clarence L. Albritton

(57) ABSTRACT

A board game device having a plurality of tri-squares, four corners and a diagonally arranged border row of eight tri-squares of a conspicuous hue extending between two corners of the board and dividing the board into two triangular sections, with a plurality of parallel rows with the center row thereof perpendicular to the border row, having a contrasting hue on different sides of the border, with proximal and distal ends thereof forming player positions at the other corner wherein each game piece has at least a tetrahedron first body member.

6 Claims, 7 Drawing Sheets

8
7
6
5
4

TRI BOARD GAME

BACKGROUND OF THE INVENTION

Board games like checkers and chess are well known. Games have been introduced that present military action and some resemblance of a medieval period displayed in the game pieces. The present invention relates to board games having the introduction of the element of chance together with the application of rules of play for special rolls and the payment of monies or game pieces for movement of game pieces. Because intellectual stimulation is desirable in any leisure challenge, the game of TRI was created to offer an intellectual challenge in a board game during leisure play.

Bialek (U.S. Pat. No. 3,794,326), shows a modified chess game that uses the element of chance wherein pictorial views of chess playing pieces are shown on the faces of chance elements (dice) and a face shown on the dice after a roll is considered in the selection of the piece to move. In TRI, the selection of a piece to move is determined by the player only. The initiation of a move is determined by special rolls and with payment for movement or nonpayment under a special rolls rule.

Christie, Jr., (U.S. Pat. No. 5,570,887), shows a board game for two to four players wherein the element of chance is introduced by the random drawing of cards and the casting of dice whereby plural pieces may be moved by a player in a single roll of the dice. Plural playing pieces may have differing levels of strength, which can vary during the game, and each may be moved by a player during a single turn. The game of TRI is played from two opposing corners of an equal lateral or diamond-shaped board whereby the game pieces are moved toward a border that extends to the other two corners of the diamond-shaped board. Magiera, Hoffman, Fisher, Hollossy, Hanna and Glass, et al. are cited of interest.

BRIEF SUMMARY OF THE INVENTION

It is an object of the present invention to set forth a diamond-shaped game board with a plurality of sixty-four checkered pattern tri-squares and having printed within each tri-square a letter and number designation representing the board position of each tri-square.

It is a further object of the invention to provide the diamond-shaped game board of eight conspicuously-labeled tri-squares extending through the center of the board and between opposing corners and forming a border line perpendicular to a player's position.

It is a further object of the invention to present a checkered board with an inverted or converse color pattern formed by at least one row of black tri-squares perpendicular to the border row whereby at least one of said black tri-squares in said at least one row of black tri-squares is contiguous to the border row on two of four sides of said at least one black tri-square; at least one row of white tri-squares perpendicular to the border row and on the side of the border row opposite said at least one row of black tri-squares whereby at least one of said white tri-squares is contiguous to the border row on two of four sides of said at least one white tri-square; and said inverted color pattern extends along the border row on each side of the board.

It is a further object of the present invention to assign and conspicuously display an assigned point value on the board for each game piece in its home-based position.

It is a further object to play the game from proximal and distal corners located on a line perpendicular to a labeled border line.

It is a further object of the invention for the players to determine if any amount of money or the total amount of money to be disbursed to each player before beginning the game.

It is a further object of the invention to pay for the movement of each game piece according to its assigned value, and within the rules of play, to capture opponent's pieces or block further movement by an opponent.

It is a further object of the invention to provide reusable set marking cards to record rounds during the game.

It is a further object of the invention to total points as an additional element of the game called TRIPOINTS to achieve a predetermined score or the most points in a predetermined number of games. See header "TRIPOINTS" below.

Skill and playing experience have been the controlling factors in the dominance of board games for many years; the introduction of chance in conjunction with the consideration of special rolls, position of pieces, and the payment or nonpayment of monies for rolls are added elements in this invention. Other objects and advantages will become apparent during the various intellectual challenges under normal game play.

BRIEF DESCRIPTION OF THE SEVERAL VIEWS OF THE DRAWING

FIG. 3*f* is a perspective view of a pair of playing dice.

DETAILED DESCRIPTION OF THE INVENTION

TRI is a board game that requires a particular board arrangement 1 whereby at least one player is positioned at apexes or corners 2,12 and play is advanced toward a notably-marked border line 3; Border line 3 is perpendicular to a line of tri-squares between opposing corners 2,12, which corners establish the positions between opposing players. The object of the game is to capture opponent's TRIPEX 4 and then make the opponent surrender. A player surrenders and loses the game, in one instance, when he wins a round rolling dice 9,10; and, having no TRIPEX 4 on the board, cannot move any of his playing pieces. When a player threatens to capture a TRIPEX the challenging player must say "TRI".

Some board games introduce the element of chance in determining the movement of game pieces; TRI starts with the rules of special rolls first and finally defaulting to a numerical value or values of dice 9,10 rolled by each player to determine which player should proceed first in the movement of game pieces; moreover, unless passing play to the opponent, a player must move any piece that can be moved, or show the declined move, otherwise the other player may remove any piece that should have been moved from the board as an overlooked move. When there is no special number combination, a large numerical value is considered which could be beyond the scope of possible moves. See header "NO ONE CAN MOVE" below.

Unlike many board games presently available, players pay a banker to move except where the rules establish other conditions for movement in the game; captured pieces can be sold during a round of play after the capture round and pieces from the playing board can be sold when a player has insufficient funds to continue normal play; nonpayment for movement or free movement is available due to a special roll; receipt of payment from a banker, receipt of an extra roll of the dice and granting of option to purchase a TRIKER are some of the possible activities in the application of the rules of the game.

TRI is a game of chance, strategy and skill wherein opposing players alternately roll dice 9, 10 in a series of rounds in an attempt to maneuver pieces offensively and defensively seeking to capture and protect pieces and territory and, at the same time, spending and accumulating monies in an effort to fuel the fight to eliminate the ultimate piece, the "TRIPEX".

Figure 1:
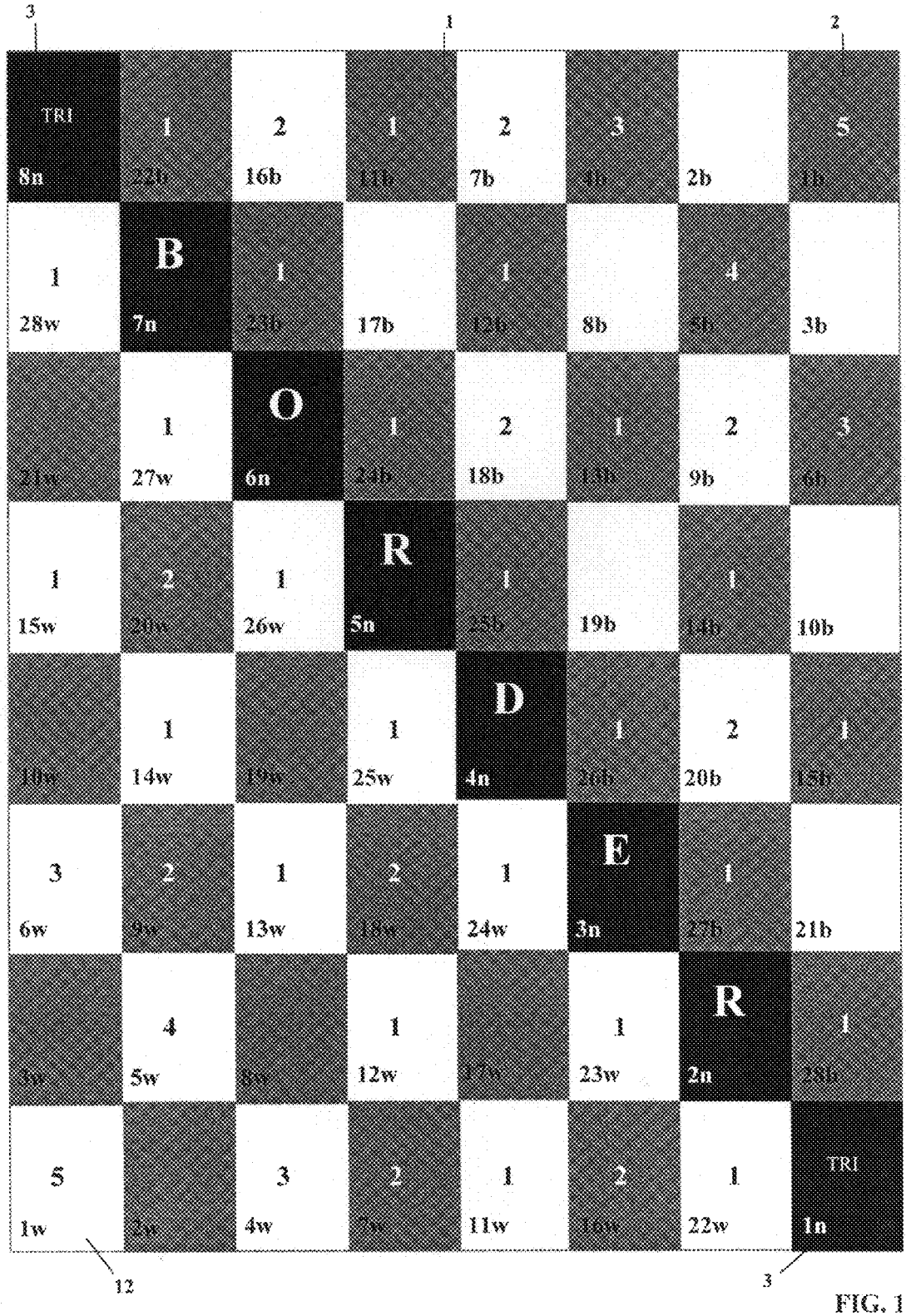
FIG. 1 is a top plan view of the game board of the invention.
Figure 2:
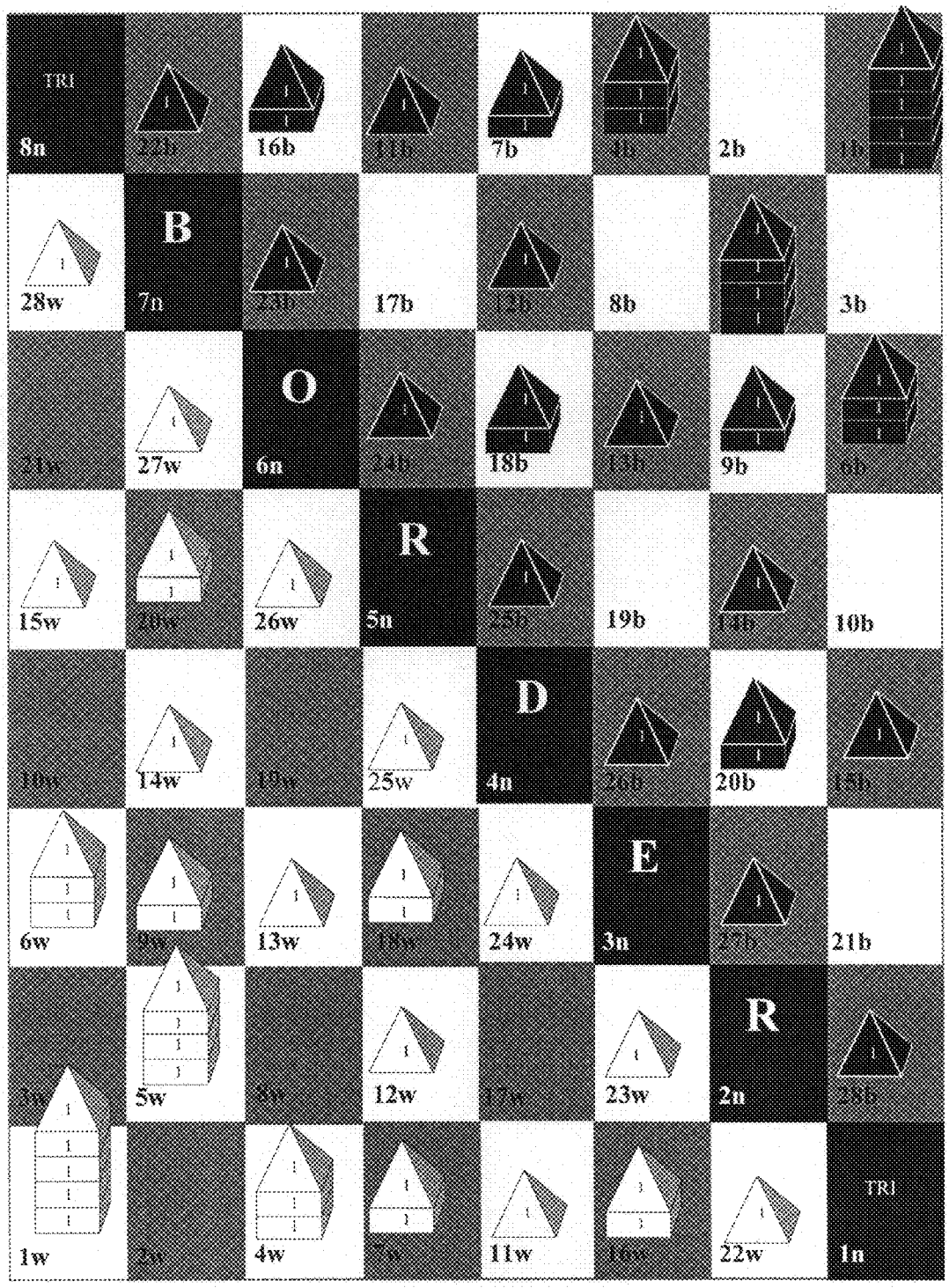
FIG. 2 is a top plan view of the game board with playing pieces located thereon.
Figures 3A, 3B, 3C, 3D, 3E:
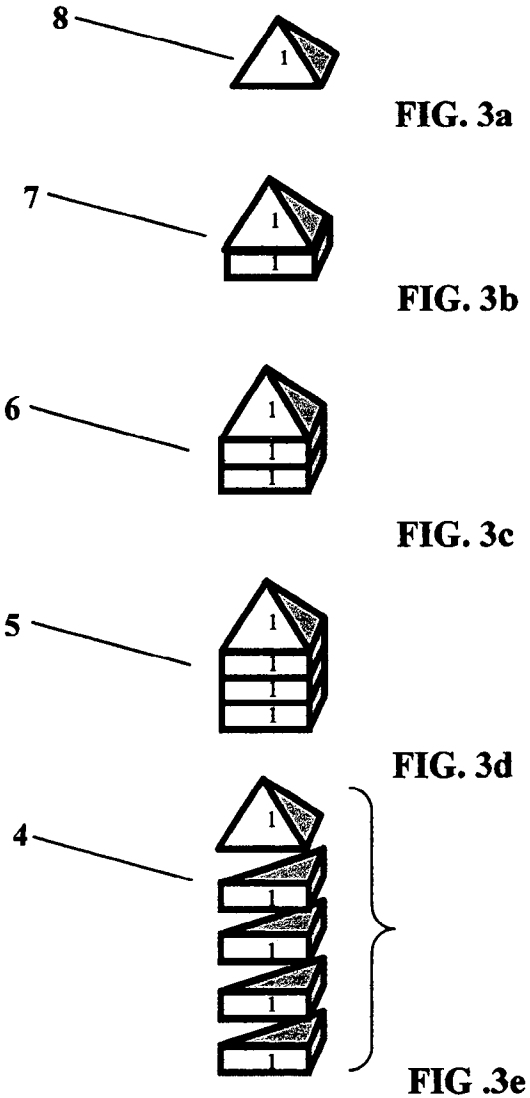
FIG. 3*a*-FIG. 3*d* are front-elevation views of the playing pieces of the game and FIG. 3*e* is a perspective view of the TRIPEX used in the game.
Figure 3F:
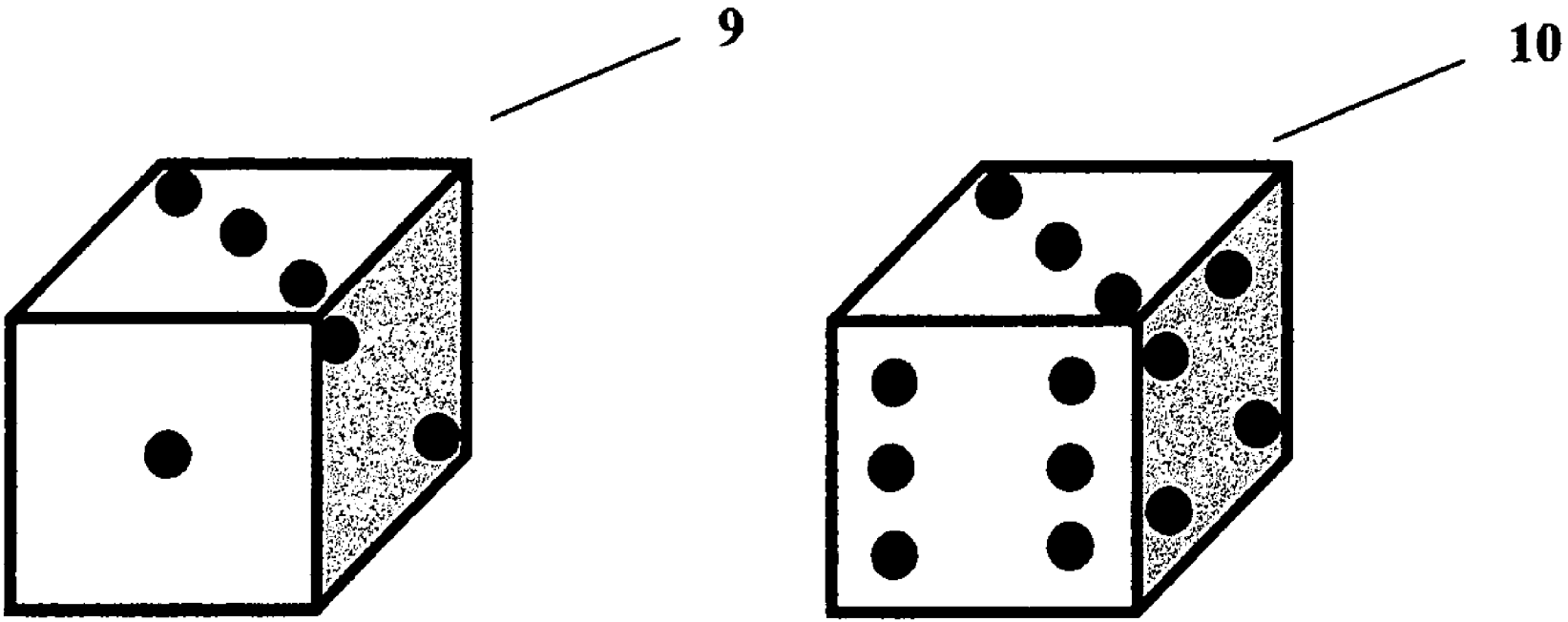
FIG. 3*f* is a perspective view of chance elements used in the game.

The Playing Board and Setup:

FIG. 1 shows a playing board 1 laid out in such a manner as to resemble a planar-shaped diamond. A single player may play the game. However, normally a player is seated at each of two opposing corners (or apexes) 2, 12 which is divided by BORDER 3. The border extends to the two other corners of said playing board. The border includes tri-squares of a different color or hue than the two-checkered colors. The word 'TRI' is printed in the first and eighth border tri-square. The word 'BORDER' is spelled out with a letter of the word in the second through seventh tri-squares along the border. As shown in FIG.2, board game pieces white in color are set up on the side of the border that has white tri-square numbers beginning with 1*w* at corner apex 12 of the board. Black pieces are set up on the side of the border that has black tri-square numbers beginning with 1*b* at corner apex 2 of the board. The pieces are set up according to each piece value, or the marked value of the home-based position for that piece. In FIG. 1, these values are represented by a number in the center of designated tri-square.

Numbered Positions:

The playing board, consists of a plurality of 64-checkered squares herein called tri-squares. The checkered board pattern is inverted at opposite corner halves of the board. Printed within the tri-square of a home base position of a playing piece is a number representing the point value of that piece. Tri-squares that are not home base positions have no point values. However, printed within every tri-square is a number and letter combination representing the assigned board position of each said tri-square. Tri-square position numbers are numbered with "W," 1*w*-28*w*, indicating white side, "N," 1*n*-8*n*, indicating Border or Neutral and "B," 1*b*-28*b*, for black side positions. A TRIPEX is positioned on each side of the board. While seated at either of the two TRIPEX home base positions, the number sequence goes from right to left, and row by row to the border. TRIKER tri-square position number 28 ends the number sequencing for each side. The border tri-squares are numbered 1*n*-8*n*, starting at the right while seated at the white TRIPEX home base position. See FIG. 2.

Playing Pieces:

In FIGS. 3*a*-3*e*, the playing pieces are primarily triangular with corrugated edges for stability. The initial setup requires 21 pieces, a different color for each player. The pieces have the configurations shown in FIGS. 3*a*-3*e*.

TRIPEX 4 (General/King) is larger than four other playing pieces with a tetrahedron pyramid on top of four stacked flat triangular chips. One piece is on the board during the initial setup. (The piece value is 5 points=$50).

TRIPEEN 5 (Captain/Queen) is next in size to the largest piece with a tetrahedron pyramid on top of three stacked flat triangular chips. One piece is on the board during the initial setup. (The piece value is 4 points=$40).

TRIMIS 6 (Missile/catapult) is smaller than the TRIPEEN with tetrahedron pyramid stacked on top of two stacked flat triangular chips. Two pieces are on the board during initial set up. (The piece value is 3 points=$30).

TRIBLK 7 Tank\Shield) is smaller than TRIMIS 6 with a tetrahedron pyramid stacked on top of one flat triangular chip. Five pieces are on the board during initial set up. (The piece value is 2 points=$20).

TRIKER 8 (Infantry) is the smallest piece; the smallest piece comprises a single tetrahedron pyramid. There are 12 TRIKERs on the board during initial set up. (The piece value is 1 point=$10).

The playing pieces may depict any desirable characteristic (i.e., Military).

The game of "TRI" consists of 60 extra playing pieces. It consists of six extra TRIPEX, six extra TRIPEENs, six extra TRIMIS, six extra TRIBLKS, and six extra TRIKERS for each player. When triangular chips and pyramids are being used, "TRI" consists of 90 flat triangular chips, and 21 small tetrahedron pyramids for each player.

Containers:

At the beginning of play, along with money, each player is given a container 11. "TRI" includes three containers of different colors, one for each player, and one for a bank. The containers have a compartment marked pieces, and three compartments marked for the different denominations of money. All extra playing pieces are initially held by the bank and placed into the pieces compartment of the container of said bank. Money is placed into said designated money compartments.

Money:

The money consists of three denominations that vary in color. The game is provided with 30 $10 bills, 30 $20 bills, and 30 $50 bills held by the bank.

Figure 4:
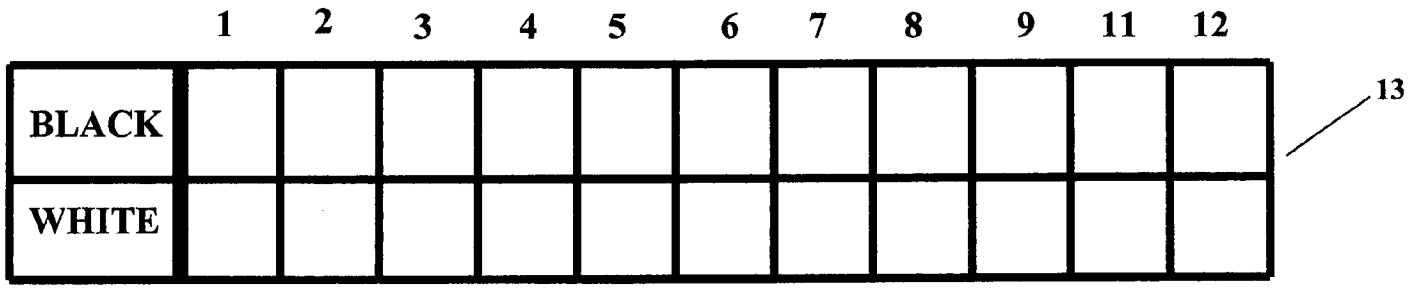
FIG. 4 is a top plan view of a reusable set marking card and FIG. 5 is a perspective view of a banking container.
Figure 5:
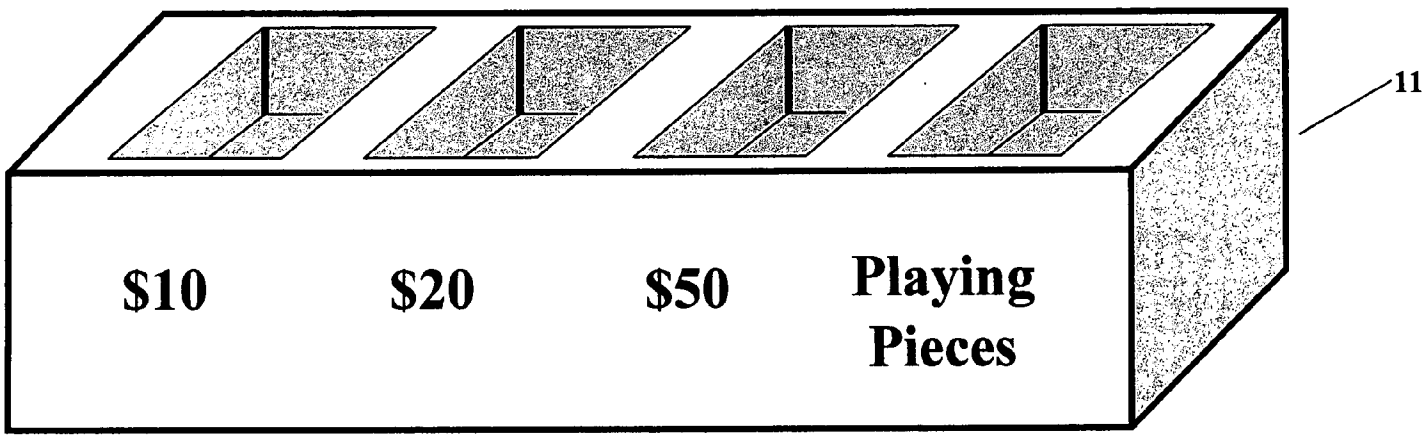

Set Marking Cards:

FIG. 4 shows reusable SET MARKING CARDS. To keep the game from becoming far reaching, when there are a total of six pieces remaining on the board, the players should begin to use SET MARKING CARDS 13 to record and track the number of sets played, up to 12 sets.

Piece, Home Base Position and Dice Values:

Each number shown on the up side of the dice represents monetarily that number times the value of $10. Each playing piece value, monetarily, is the point value of that piece times $10. Each home base position value on the board is equal, monetarily, to the point value of said position times $10.

The Bank:

The term bank or banker is hereafter used interchangeably. A designated banker is holder of the money, container 11, set marking cards 13, and surplus playing pieces 4-8. As dictated by the rules, he will disburse or receive monies and playing pieces. In addition, he keeps a record of any monies owed. When a player does not have enough money to move a playing piece or to pay the bank and opponent, the player must sell to the bank, any captured piece(s) belonging to his opponent whose rounded value is equal to or greater than the owed amount. When there are no captured pieces to sell, the player must sell any of his piece(s) that are on the board whose rounded value is equal to or greater than the owed amount. For a player to sell pieces, the exchange must cover the amount owed. Captured pieces cannot be sold to the bank in the same round of their capture. When owed to the bank, the banker will receive payment in cash and playing pieces that will cover the debt. When a piece has to be taken from off the board to be sold to the bank, the banker will take what is owed from the piece value and if there is any remainder, the bank will return the remainder in piece value and place it onto the tri-square where the sold piece was taken. Excluding free moves of 3+(any number), each move costs the monetary value of the piece to be moved. In addition, a player must pay the bank monies equaling the monetary value of any playing piece that the player buys from the bank. When a player has a TRIPEX on the board and has no money or playing pieces to pay the bank or the opponent, the player gets a loan from the bank for the amount owed. The bank will in turn keep a running balance of the player's account and make note of all debits and credits. All monies that are to go to that player from the opponent or the bank goes to the bank until the debt is paid in full. All transactions of monies should be completed before moves are made.

Strategy:

The strategy of the TRI board game is to capture the opponent's TRIPEX and as many major pieces as possible. A player should try to get as many of his own TRIKERS and TRIBLKS onto the border as possible to gain avenues into the opponent's territory by bridging. See section "Bridging Pieces'" below. The player should try to get as many pieces as possible onto the opponent's tri-squares of the highest point value. The former holds true especially when the players are totaling points in a further element of "TRI" referred to as tri-points. See section on "TRIPOINTS" below. A player should seek to gain pieces, monies and territory during play and most importantly the player should try to force a surrender by first capturing the opponent's TRIPEX and then maneuvering pieces in the paths of the opponent's pieces, thus limiting and eliminating movement of the opponent's pieces. At the same time, the player should attempt to move pieces in such a way as to increase his own ability to move. Players should also try to position their pieces onto their opponent's home base positions to get more major pieces onto the board.

Rounds:

A round comprises a series of beginning and ending rolls of the dice and related moves within a division of action according to the set rules that apply to the numbers showed on the dice.

Play Sequencing:

Play within rounds should follow the sequencing of: first, rolling of the dice, second, all Monetary Transactions, and third, Movement of pieces. The order of play should be followed for each division of action according to the rules applicable to the numbers indicated on the dice within a round. A roll of 1+1 on an extra roll of the dice during a round ends all subsequent play within the round, and the opponent will roll the dice to begin a new round. See "Special Combinations" below.

Rules:

Two players should play TRI although it may be played solitarily. A person is designated as a banker. Each player receives a container for his money and game pieces. Before play begins, each player would agree upon an equal amount of money to be received from the banker. The players may agree not to receive initial monies or any amount in $30 increments, for instance $30, $60, $90 etc. Monetarily, each point value of a playing piece equates to $10× playing piece point value. Each player receives a pair of regular six-sided dice of different colors (i.e., one pair black with white dots and one pair white with black dots). To begin the game each player rolls his dice to establish which player should roll first to begin the first round. The player with the higher total makes that determination. Throughout the game, play continues with the player winning the previous round rolling the dice first to begin a new round. A player winning a round may or may not move a playing piece. See "Winner of Round Passes Move" below. If he does pass on a move, he must show the declined move, otherwise the opposing player may (before rolling the dice again) take any piece that could have been moved off the board as an overlooked move and put it into the pieces compartment of his container. The winner of a round is determined by the higher total against the precedence of special combinations as indicated by the roll of the dice. Refer to the "Special Combinations" section of these instructions. For example, if one player rolls a 7 and a 2 totaling 9 while the opposing player rolls a 5 and a 2 totaling 7, the player rolling the 7+2, being the higher combination would win the round. When a player has the higher total, thus winning the round, but cannot move a playing piece, refer to rules "Winner of Round Cannot Move" or "No One Can Move" below. When totals are the same and a player rolls a double number, the player rolling the double numbers win over all rolls excluding 3+ (any number). Players rolling double numbers may opt to move according to the total of both dice or according to the number showed on a single die. For example, if a player rolls double 5s (10), that player would beat the player that rolls a 6 and a 4 equaling (10) and could move ten tri-square positions or move according to the number indicated on a single die, which would be five tri-square positions. Moreover, when the total for both players are the same, and 3+ (any number) or double numbers are not rolled, the player with the higher number showed on a single die wins the round and will move according to the higher number of his dice. For instance, if both players roll a total of 7 with one player a 5 and a 2 and the other rolling a 6 and a 1, the player that rolled the 6+1 wins the round and will move according to the higher number of the dice, which is 6. The player ending a movement of a playing piece on an opponent piece's home base position, may request from the banker in exchange of that conquering piece, one of his own pieces equaling the value of the opponent's home base position on which the conquering piece landed. Of course, the player must pay the bank for the value of the exchanged piece. The amount to be paid equals the value of the conquered home base position minus (−) the value of the conquering piece. The request for an exchange must be made when that conquering piece first moves onto an opponent's home base position. When the request for an exchange is initially overlooked and the conquering piece is already situated on an opponent's home base position, the player cannot request an exchange for that piece. To request an exchange on that home base position, he must first reposition that piece and move it back to that position on a subsequent move.

Special Combinations:

The following are special number combinations in their hierarchical order and the rules that apply:

3+3—although considered also as 3+ (any number) rolls of 3+3 win over all combinations. The player rolling 3+3 receives $60 from the banker, pays nothing for a move of three or six tri-square positions and gets an extra roll of his dice in the round. The player has an option of purchasing a TRIKER from the bank and putting it into play onto any open tri-square on his own side of the border or any other open tri-square on the board that has a point value equal to or less than 1. When he opts not to buy, play continues to the end of the round. When rolled by a player defending against a firing TRIMIS, 3+3 shoots down the firing TRIMIS and the player receives $30 from the opponent. When duplicating both of the opponent's dice while defending against a firing TRIMIS, the defender receives $60 from the opposing player. When rolled during a TRIPEX escape attempt the player does not get an extra turn.

2+1—beats all rolls except 3+3. The player that rolls 2+1 may opt to receive $20 from the banker or move one of his pieces one, two, or three tri-square positions. The player still must pay the banker the monetary value of the piece being moved. In addition, 2+1 can shoot down a firing TRIMIS when the firing number is three. When rolled during a TRIPEX escape attempt, a player may pay the bank to move any playing piece one, two, or three tri-square positions to hinder the capture of his TRIPEX.

6+6—beats all rolls except for 2+1 and 3+3. When the player rolling 6+6 can move a playing piece, he first receives from the banker the monetary value of the higher number of the opponent's dice that was rolled. After paying the bank the monetary value to move the piece, the player may move six or twelve tri-square positions. Also, the player, after paying the bank $20 may buy a TRIBLK from the bank and place it onto any open TRIBLK home base position on his side of the border. When there is not an open TRIBLK home base position, the player must place the TRIBLK onto any open tri-square of lesser value on his side of the border. If the player rolling 6+6 cannot move a playing piece, he receives nothing from the bank nor can he purchase a TRIBLK, and play is passed to the opponent and the numbers already showed on the opponent's dice. Moreover, if the opponent receiving the passed play can move any piece, he may play according to the numbers showed on his own dice or he may roll the dice again for a new set of numbers. If he cannot move any piece, the round ends and the player that rolled 6+6 to begin the round must roll his dice to begin a new round. When 6+6 is rolled during an extra turn, the player receives from the bank the value of the higher number showed on the opponent's dice that are already rolled. In addition, a player rolling 6+6 shoots down a firing TRIMIS and when duplicating both dice of a firing number while defending against a firing TRIMIS, the defender receives $60 from the opponent.

3+ (ANY NUMBER) beats all rolls except other special combinations of 3+3, 2+1 and 6+6. The player moves either three tri-square positions or the number of tri-square positions indicated on the other die or the total tri-square positions of both dice without paying the bank for the value of piece to be moved. When both players have rolled their dice, and if either player roll a 3+ (any number), any matching number(s) will be canceled out and the player with the number 3 or the higher of the any number wins the round. When both numbers in a 3+ (any number) combination matches, a TRIKER cannot be bought; the round is cancelled out; and, play continues with the player winning the previous round rolling his dice first to begin a new round. 3+ (any number) also shoot down a firing TRIMIS when any number on either of the defender's dice matches the firing number. When duplicating both dice of a firing TRIMIS, the defending player receives the monetary value of the other number rolled with the 3 times $10 from the opponent.

DOUBLE NUMBERS—occur when a player rolls matching numbers on both of his dice. Double numbers win over all combinations, other than a 3+(any number) combination, when the totals are equal. Examples of double numbers are 4+4, 6+6 and 2+2. Double numbers allow the player to move a playing piece the number of tri-square positions according to the total of both of his dice, or the number of tri-squares showed on a single die. The player must pay the banker the monetary value of the piece to move. It shoots down a firing TRIMIS when the number matching the firing number is on a single die. Double 1's loses the round and the opponent gets an extra turn to roll the dice.

1+1—loses the round and the opposing player gets an extra turn to roll his dice in the round. The player rolling 1+1 gives the opponent the monetary value of the lower number showing on the opponent's dice times $10. In addition, the opponent may move any piece, belonging to the player that rolled the 1+1 combination, which is not on its own home base position, to any open tri-square of no value. When 1+1 is rolled on an extra turn or extra roll, all play within the round ends at that point and the opponent rolls the dice to begin a new round.

DUPLICATE NUMBERS—excluding rolls of duplicate 2+1, 6+6, 3+(any number) or 1+1, the second player rolling the dice matching both numbers indicated on an opponent's dice may, after paying the banker $10 for the purchase of a TRIKER, place it onto any open tri-square on his own side of the border. See the specific rule applicable to the previously mentioned excluded combinations following in this section. When defending against a firing TRIMIS and 3+(any number) matches both numbers indicated on the dice of the player attempting to fire the TRIMIS, the defending player receives the monetary value of the number accompanying the 3 from the opponent, and shoots down the firing TRIMIS. When both numbers of a firing TRIMIS are duplicated, the player rolling the duplicate in defense receives from the opponent the monetary equivalent of the lower number showed on the dice times $10.

DUPLICATE 3+ (any number) the round is cancelled out.

DUPLICATE 6+6—when the second player rolling his dice duplicates the opponent's roll of 6+6 and can move, he receives $120 from the banker, pays the banker the monetary value of the playing piece he desires to move, and then pays the banker $40 for the purchase of two TRIBLKS. If the player rolling the 6+6 duplicate cannot move, he may only purchase a TRIBLK from the bank for $20 and place it onto any open TRIBLK home base position on his own side of the border. When there is not an open TRIBLK home base position, the player must place the TRIBLK onto any open tri-square with a point value less than two on his own side on the border. If he decides not to purchase a TRIBLK, the round ends and that player rolls his dice to begin a new round.

DUPLICATE 2+1—the second player rolling the duplicate 2+1 may move any one playing piece or any two playing pieces one, two or three tri-square positions. The player has to pay the bank the monetary value of the piece(s) to be moved. If the player moves one piece he receives $20 from the bank, for moving two piece(s) he receives nothing, however if he doesn't move any piece(s), he receives $40 from the bank.

EQUAL TOTALS—when the players roll an equal total, the player rolling the higher number on a single die wins the round and moves the number of tri-squares according to the higher number. However, when double numbers are rolled, the double numbers win over all other combinations but 3+ (any number).

1+1, 3+3—when a player roll 1+1 while the other player roll 3+3, the player that rolled 3+3, first receives $60 from the banker, and then receives $30 from the opponent. He next gets two extra rolls of the dice. After paying the bank for the purchase of a TRIKER, he places it onto any open tri-square that has no point value. In addition, the player may move any opponent's piece that is not on its own home base position to any open tri-square on the board of no value.

Any combination of the aforementioned special combinations may apply on a given move.

Ways To Win the Game:

1. By capturing and removing the opponent's TRIPEX from the board and afterwards the opponent is unable to move any playing piece on winning a round. Due to an extra turn, a player cannot lose on a roll of double 3s or the opposing player rolls double is. When both players do not have a TRIPEX on the board, and the player that initiates the round cannot move a playing piece, see Section "No one can move" below.

2. When a player captures all playing pieces belonging to the opponent.

3. When a player does not have a TRIPEX on the board; and on winning a round has not enough money neither can he sell a playing piece to the banker; and cannot move a playing piece.

4. When six playing pieces are on the board, the banker will begin to record the number of sets played on the set marking cards. The game ends after 12 sets and the winner will be determined by the highest total point value. Any player's piece(s) on any opponent's home base positions will be added to the piece's point value. Points are totaled by adding the occupying piece point value with the opponent's home base position value occupied by that piece.

5. At games end, when one player has a TRIPEX remaining and his opponent do not, the player with the remaining TRIPEX wins the game.

6. When a player does not have a TRIPEX on the board and rolls 1+1 on an extra turn that player loses the game.

7. When the TRIPEX for both players are remaining at the end of the game, the winner is the player with the higher point total. Points are totaled by piece point value +opponent's occupied home base position value.

8. When both players roll a number beyond their scope of moves, and when one player does not have a TRIPEX on the board, the player without the TRIPEX loses the game.

9. It is possible for a game to end in a tie.

Movement of Pieces:

The following chart represents each playing piece and the number of tri-square positions the playing piece may be moved when beginning its move from its home base position and not bridging a border piece:

| PIECE: | Moves on rolls of: |
|---|---|
| TRIPEX | 1, 4 |
| TRIPEEN | 1, 3, 5, 6 |
| TRIMIS | 1, 3, 4, 5, 6, 7 |
| TRIBLK | 1, 2, 4, 5, 8, 10 |
| TRIKER | 1, 2, 3 |

Horizontal, Vertical and Diagonal Moves:

Diagonal moves are any movement of a playing piece across the apex of a tri-square. Horizontal and vertical are moves that are not across the apex of a tri-square. The border tri-squares are considered neutral; therefore, moves along the border may be considered diagonal, horizontal, or vertical. A playing piece entering the border diagonally must exit diagonally, and a playing piece entering the border horizontally or vertically must exit the border horizontally or vertically.

Figure 6:
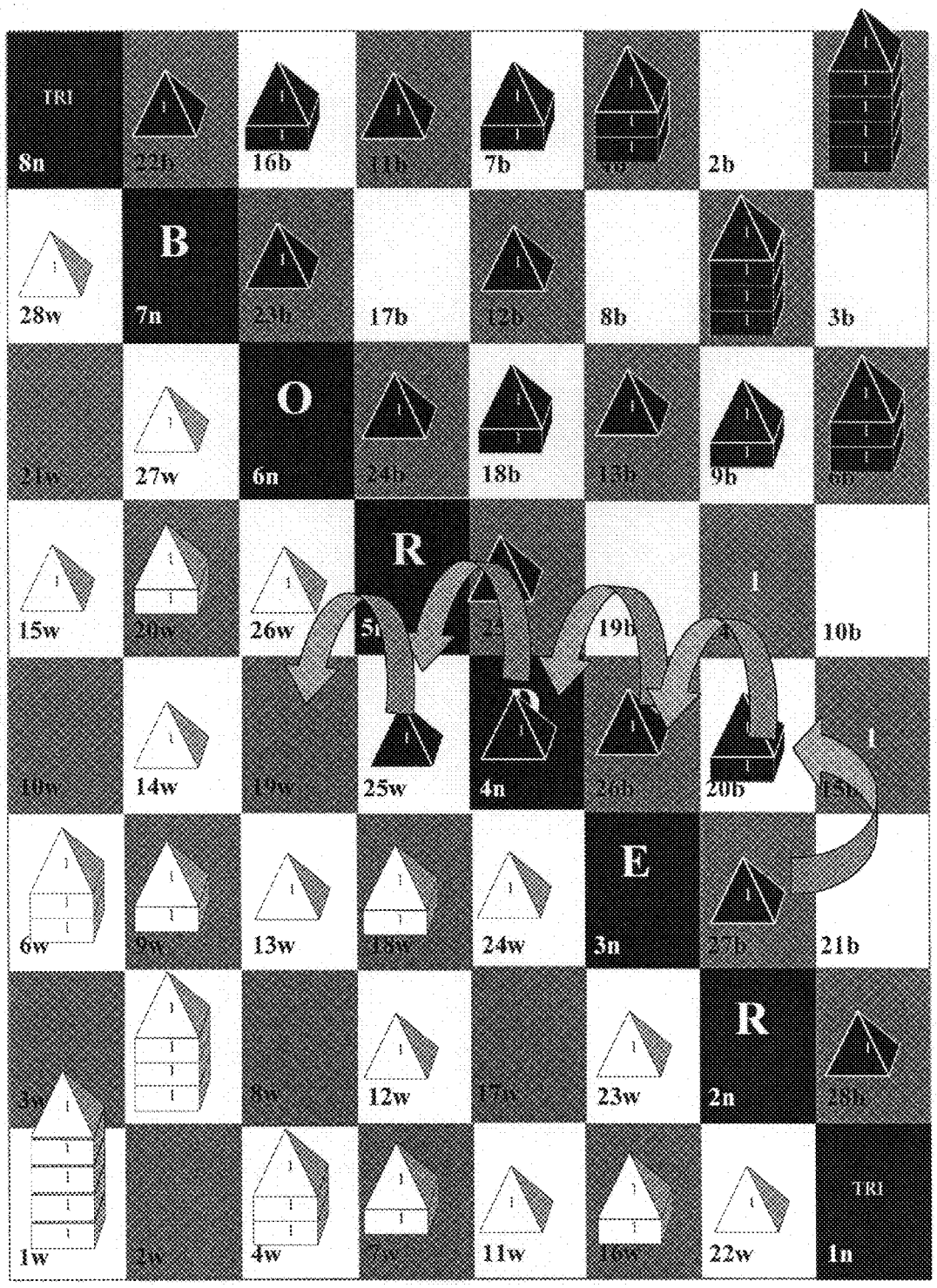
FIG. 6 is the game board of FIG. 1 showing bridging and FIG. 7 is the game board of FIG. 1 showing action by a TRIMIS.

Bridging Pieces:

Bridging is when a playing piece is moved across tri-squares occupied by one or more of its own piece(s) without moving across an empty tri-square during a given move. See FIG. 6. Excluding the TRIMIS, all pieces may bridge. A player may bridge a TRIPEX over any of its own pieces. The TRIPEEN may be bridged over any of its own pieces of equal or lesser value. TRIKERS, TRIBLKS and TRIPEENS may be bridged over one another.

Firing Pieces:

TRIMIS 6 is the only piece that may be fired over or jump over an opponent's piece(s) and spaces on a given move, therefore it is considered as firing over or airborne. Any opponent's piece(s) except TRIBLK 7 that is in the path of the firing TRIMIS 6 may attempt to shoot it down.

The Tripex (General/King):

TRIPEX 4 is the crown jewel and ultimate piece. A Player may move a TRIPEX in any single direction. It may be moved on a 3+(any number) combination. In addition, it may be moved on a roll of 2+1 during an escape attempt. Excluding rolls of 3+(any number), the player must pay the banker $50 to move TRIPEX 4. A player may move (bridge) a TRIPEX over any of his own piece(s). The TRIPEX also can be moved across empty spaces. However, it cannot be moved across both pieces and empty spaces on a given move. It may be moved across the border in any single direction. A Player may move a TRIPEX in any direction to capture any piece belonging to the opponent.

Threatening the Tripex:

When the TRIPEX is threatened or in the position to be captured, the challenging player is to say "TRI". The challenged player will then have the opportunity to roll his dice to try to roll 3+ (any number) or 2+1 in an effort to allow his TRIPEX to "TRI" to escape. When threatened by a player's TRIMIS, and the TRIPEX is able to escape, the attacking player must still move the TRIMIS and pay the bank $30. He also, must pay the bank to move any other piece according to the threatening number. The threatening player will then roll the dice for a new set of numbers during the same round.

Tripex Escape:

When a player rolls 3+(any number) or 2+1 during an escape attempt, the player may, after paying the banker, move a playing piece in the path of the challenging piece to block a capture, capture a challenging piece, destroy the bridge by capturing a bridged piece or when possible he may move the TRIPEX. A challenging TRIPEX cannot be threatened or challenged on a given move. The challenged TRIPEX cannot challenge a TRIPEX during an escape attempt on a given move. A challenged TRIPEX may move to a tri-square where another piece would readily challenge it during an escape. However, it still would be captured, nevertheless by a different piece. When a player cannot move a playing piece to hinder a capture, no other piece should be moved and play is returned to the challenger who will proceed to capture the TRIPEX. The game cannot end on a passed move. When the TRIPEX escapes, the challenging player will move first any piece according to the challenging number and then roll the dice again for a new set of numbers. When threatened by a player attempting to fire a TRIMIS and the TRIMIS is shot down, the threatening player does not get an extra turn. When a TRIPEX escapes and the challenging player cannot move a playing piece according to the original challenging number, the escaping opponent rolls the dice to begin a new round. When the TRIPEX is unable to escape, the challenger may capture the TRIPEX and then roll the dice again for an extra roll of the dice in the round. A TRIMIS cannot be fired in defense in an attempted escape.

The Tripeen (Captain/Queen):

TRIPEEN 5 is versatile and can be used to cover quickly a lot of ground. Unless a player rolls 3+ (any number), he must pay the banker $40 to move a TRIPEEN. He may move the TRIPEEN over both empty spaces and his own pieces of equal or lesser value on a given move. Also, a player may bridge TRIPEEN 5 over any of his own pieces except TRIPEX 4. A player may move any of his own pieces over or bridge over his own TRIPEEN. The TRIPEEN may capture any piece in any direction.

The Trimis (Missle/Catapult):

TRIMIS 6 is a potent, dangerous, offensive and defensive weapon and may be used to protect several of its playing pieces and territory or capture several of the opponent's pieces and territory on a given move. Excluding rolls of 3+ (any number), the player must pay the banker $30 for an attempted move. The opponent may or may not defend against a firing TRIMIS. A firing TRIMIS is one that attempts to jump over pieces on a given move. A TRIMIS fired from its own home base position cannot capture an opponent's piece that is situated on a tri-square on the firing TRIMIS' side of the border or territory. When an opponent's piece is in the path of a firing TRIMIS and the player wishes to defend against it, the defender must pay the banker monies equaling the value of the defending piece times $10. The TRIMIS can be moved across empty spaces in any single direction or fired over both empty spaces and any of its own pieces. A player may also, attempt to fire a TRIMIS over any of the opponent's piece in its path (except TRIBLK) in any single direction. When he is not attempting to fire the TRIMIS, it can capture only diagonally. A TRIMIS cannot be fired in defense during a TRIPEX escape attempt.

Figure 7:
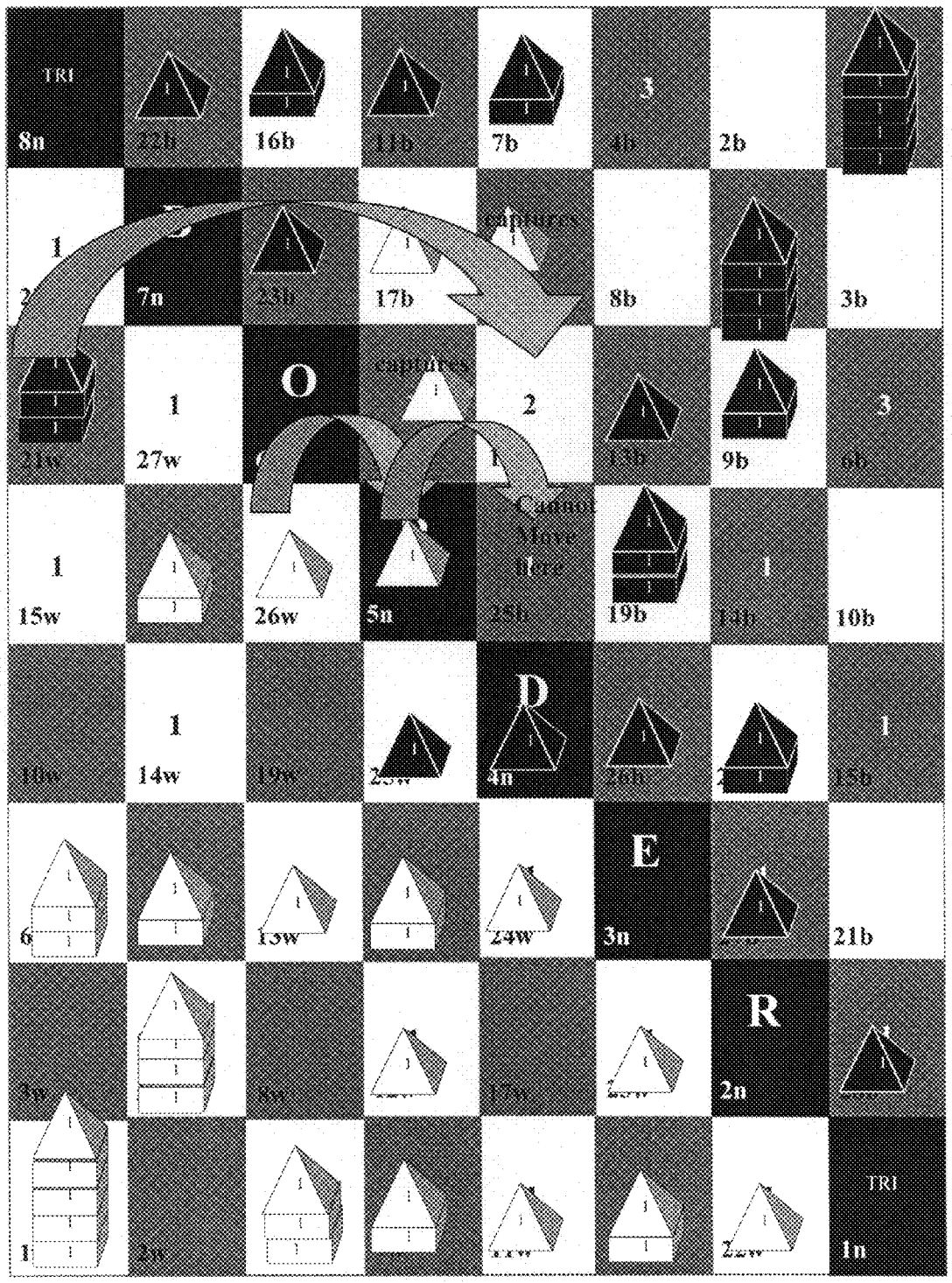

Defense against a Firing Trimis:

A player must tell the opponent when and how he will attempt to fire over the opponent's piece(s). The opponent may concede the attack by not defending against it. If the opponent wants to defend the attack, the opponent must pay the banker the value of each defending piece that will try to shoot down the firing TRIMIS along its path. See FIG. 7. After paying the bank the monetary value of each defending piece's point value times $10, the opponent will roll the dice in an attempt to roll a number that shoots down the firing TRIMIS. After paying the bank the money to defend, the opponent will roll the dice once for each point value of the piece the TRIMIS attempts to fire over. For example, when the firing number is five and the TRIMIS is attempting to jump over two of the opponent's pieces along its firing path, for instance, a TRIKER and TRIMIS, the opponent will have up to four rolls of the dice to try to roll a total of five to match the threatening firing number. Each TRIPEX point value is five therefore, $50 must be paid to the bank, because 5×$10=($50). Each TRIPEEN point value is four therefore, $40 must be paid to the bank, because 4×$10=($40). Each TRIMIS point value is three therefore, $30 must be paid to the bank, because 3×$10=($30). Each TRIKER point value is one therefore, $10 must be paid to the bank, because, 1×$10=($10). Therefore, attempting to fire over a TRIMIS+TRIKER=four, giving the defender up to four rolls of the dice, thus costing 4×$10 ($40). The defender may choose not to expend the total amount of money and rolls entitled him for having his pieces in the path of the defender's firing TRIMIS, but may expend only a portion of the entitlement. When defending against a TRIMIS that is firing on double numbers, and the double numbers are duplicated other than 6+6, 1+1 or 3+3 by the defender, the defender receives $30 from the opponent. When the opponent rolls a number matching or totaling the firing number, that player would remove the TRIMIS from play, and put it into his container before it does any damage. A double number, 3+3 or 3+ (any number), having either of the numbers matching the firing number can also shoot down a TRIMIS. When a player rolls 6+6 and is shot down, that player does not get to buy a TRIBLK and the round ends. When any of the above conditions are met, the defender will remove the TRIMIS from play. Play continues with the player who was threatening to fire, rolling his dice first to begin a new round.

Trimis Capturing Opponent's Pieces:

When a player fires a TRIMIS over a playing piece and it lands onto a tri-square the color of the opponent's TRIPEX home base position, he captures any opponent's piece(s) that are situated on any of the adjacent tri-squares of a different color excluding the border. See FIG. 7. Conversely, when the TRIPEX and TRIBLK are situated on their own home base tri-squares the TRIMIS must land directly on that tri-square to capture them. Unless being fired over a playing piece, a TRIMIS cannot be moved to a tri-square the color of the opponent's TRIPEX home base position, when an opponent's piece(s) are situated on any of the adjacent tri-square of a different color excluding the border. When a TRIMIS is already situated on a tri-square the color of the opponent's TRIPEX home base position, the opponent cannot move any piece onto any of the adjacent tri-squares of a different color connected to the tri-square occupied by the opponent's TRIMIS. See FIG. 7. However, if the opponent does move a playing piece to one of the said adjacent tri-squares of a different color excluding the border, and the move is unnoticed by the player of the defending TRIMIS, the TRIMIS loses power over the said adjacent tri-squares of a different color. The opponent will then be able to move pieces to any of the said tri-squares adjacent to the tri-square occupied by the defending TRIMIS. The TRIMIS will not have power over those said adjacent tri-squares until the opponent vacates those adjacent tri-squares.

The Triblk (Tank/Shield):

The TRIBLK is a powerful defensive, as well as an offensive playing piece that may be used to block the path of an attacking opponent's playing pieces. When a player does not roll 3+ (any number), he must pay the banker $20 to move a TRIBLK. A player cannot move a playing piece across a tri-square that is occupied by an opponent's TRIKBLK. A player may move a TRIBLK in any one direction or multidirectional by bridging only over his own TRIPEEN, TRIBLK or TRIKER. It can change direction only by pivoting over any of his TRIBLK, TRIPEEN or over his TRIKER that is situated on the border. A player may move a TRIBLK to capture any piece in any direction. Unlike a TRIKER, a player may bridge a TRIBLK multidirectional without bridging a border piece. Unless bridging pieces along the border, a player must continue the pattern of the piece's movement throughout the duration of a move, even when pivoting over its own TRIBLK, for instance, when it begins a move vertical or horizontal it must continue vertical and horizontal throughout a given move. However, the pattern may be broken to bridge along the border, but when exiting the border it must exit vertically or horizontally. When beginning a diagonal pattern, a diagonal pattern must be continued throughout a given move. A player may move a TRIBLK across the border in any single direction or multidirectional by bridging his TRIKER or TRIBLK situated on the border. When a player rolls 6+6 and purchases a TRIBLK, he must put it on any open TRIBLK home position in his own territory. If there are no open TRIBLK home base positions in his territory, he must then place the TRIBLK on any open tri-square on his own territory with a point value equal to or less than 2. The TRIBLK cannot be exchanged for another piece when landing on an opponent's home base position. TRIBLKS may be captured by any opponent's piece of equal or greater value. When a TRIKBLK is situated on its own home base position, a firing TRIMIS must land directly on the TRIMIS home base tri-square to capture it. TRIBLKS cannot bridge during a retreat across the border. A player cannot move a TRIBLK to capture an opponent's piece while retreating on a given move, except when it ends its move on the border or on the opponent's side of the border.

The Trikers (Infantry):

The TRIKER at times could be used as cannon fodder. Nevertheless, they are effective both offensively and defensively. A player must pay the bank $10 to move a TRIKER. A Player may move his TRIKERS within his own side of the border in any single direction. However, by bridging its own TRIPEEN, TRIKERS and TRIBLKS situated on the border a player may move it multidirectional. When doing so, the player must end the TRIKER move on the border or on the opponent's side of the border. A move beginning diagonally must continue diagonal throughout a given move. A move a beginning horizontally and vertically must continue horizontally and vertically throughout a given move. However, the pattern may be broken when moving along the border, but the exit from the border must be vertical or horizontal. A player cannot move a TRIKER over both empty spaces and pieces on a given move. When TRIKERS are not bridging, they can only capture diagonally. A player may bridge TRIKERS only over his own TRIPEEN, TRIKER and TRIBLK without capturing on a given move. TRIKERS can be moved to capture all pieces, excluding TRIBLKS. TRIKERS can be moved multidirectional by bridging without bridging a border piece when beginning its move from within the opponent's territory. Beginning a move outside the border, a player can move a TRIKER to capture an opponent's piece situated on the border only by bridging. The TRIKER can cross the border only by bridging, by moving it three tri-square positions, or by moving it diagonally (across the apex) of a tri-square the color of his TRIPEX home base position in a single direction. Unless when bridging, TRIKERs within the opponent's territory, can only be moved across tri-squares with a value equal to or less than one (1). Players beginning a TRIKER move from the opponent's side of the border and retreating across the border to its own territory cannot bridge, however, it may retreat to its own side of the border in any direction. A player cannot move a TRIKER to capture an opponent's piece while retreating on a given move, except when it ends its move on the border or on opponent's side of the border.

Winner of Round Passes Move:

The player winning the round may pass or decline a move as long as he has a TRIPEX on the board. A player also cannot pass a move during an extra turn. When a player passes a move, he must say "TRIPASS" and show the opposing player what move he is declining, otherwise the opposing player may (before the dice is rolled again) take any piece that could have been moved off the board as an overlooked move and put it into the pieces compartment of his container. When a move is passed no piece is moved during the round and the round winner that chose not to move will roll the dice for a new set of numbers to begin a new round.

Winner of Round Cannot Move:

When the winner of the round cannot move, and his opponent rolls a number that would allow him to move a playing piece, the winner of the round pays his opponent the monetary value of lowest number on either of the opponent's dice. Play is conceded to the opponent and the numbers showed on the opponent's dice. The opponent in turn may choose not to move according to the numbers already showed on his dice. However, he must roll again and move according to the new set of numbers. If he does not have a TRIPEX and cannot move, he loses the game.

No One Can Move:

When no one can move because the numbers rolled are beyond the scope of possible moves for both players, both players must pay the banker the monetary value equaling the lowest number on either player's dice times the value of $10. If either player does not have a TRIPEX on the board and cannot move, that player loses the game. When both players do not have a TRIPEX on the board, and when both players cannot move, play continues with the player beginning the round rolling the dice first to begin a new round. When the winner of the round cannot move, and the opponent rolls a number that allows him to move a playing piece, the winner of the round pays his opponent the monetary value of lowest number on either of the opponent's dice. Play is conceded to the opponent and the numbers showed on the opponent's dice. The opponent in turn may choose not to move according to the numbers already showed on his dice. However, he must roll again and move according to the new set of numbers. If he does not have a TRIPEX and cannot move, he loses the game.

TRI-Points:

"TRI" may also be played to see which player would be the first to reach a predetermined number of points, or the player that gets the most points in a predetermined number of games. After each game, the point values of any remaining pieces are added together. Any pieces situated on its opponents territory or side of the border will be added along with the point value of the occupied tri-square or home base positions. For instance, a TRIKER still on the border or his own side of the border would still be worth one point, because border tri-squares have no point value. If a TRIKER were situated on his opponent's TRIPEEN home base position it would be worth five points because 1 (TRIKER value)+4 (opponent's TRIPEEN home base value)=5 when tallying points at the end of the game. Pieces situated on their own territory at game's end will not be added to a tri-square point value. The games will be repeated until the predetermined number of points or games is reached. See sample of chart adding point totals.

The Following Rule Should be Applied to TRI-Points Only:

The game winner with the remaining TRIPEX should always assume the higher point total. If the loser of the game has the higher point total, the winner would record the loser's higher total as his own and total, the winner would record the loser's higher point total as his own and the loser would always record the lesser point total of the winner having the remaining TRIPEX as his own.

Tricodes:

Tricodes are algebraic notations that allow one to read and write "TRI" moves. The codes may also serve as an algorithm for an electronic game. The following chart denotes the codes meaning and examples.

Computerized TRI Board Game:

Another element of the "TRI" board game is an electronic version with two sets of distinguishable playing pieces as stated in the section "PLAYING PIECES" in this document. The characteristic of playing board and other elements of the game is aforementioned. The game has a display device for displaying the visual images of the pieces and game board. An input device is needed for inputting data as a means for processing the data to allow a player to move the playing pieces about the displayed board. It would require a memory device for storing the data via an application program. The memory will transfer the program and display a graphical user interface (GUI) on the display device. A bus will transport the input and output signals among the input device, the display device and the memory device. The game may be played on the Internet, standalone or networked personal computers, palm pilots, cell phones and virtually any electronic computerized device. The interface software would be stored via a readable medium enabling the computer or microprocessor to interact with a user. A further component that may be carried out through an electronic system of play is to compute quickly and display possible movement of pieces to the opposing players. Thus, when a player overlooks a move the overlooked moves may be quickly identified and acted on by an opponent. The computer can also quickly identify an illegal move by quickly sending an electronic alert to the players.

TRI-CODES for Writing Codes of Play:

| CODE | MEANING | EXAMPLE |
|---|---|---|
| W | WHITE PIECE | WTK (White TRIBLK) |
| B | BLACK PIECE | BTR (Black TRIKER) |
| TR | TRIKER | |
| TK | TRIBLK | |
| TS | TRIMIS | |
| TN | TRIPEEN | |
| TX | TRIPEX | |
| bk | BANK | B + $30bk Black gains $30 from the bank |
| ( ) (-) | Pass play to opponent when cannot move | B11 ( ) (-) Black cannot move 11 and passes play to white |
| (--) | Decline move | W7 (--) White declines move of 7 |
| ( ) | Can Not Move | B8 ( ) 6 + 2 Black can not move 8 |
| Player code followed by number, For example, W3 | Move indicated number of tri-square positions due to special situations | , B4, Black moves 4 tri-square positions or ... W5 + 1, B3 + 1, B3, B wins the round with special number 3, although after canceling out the 1s, W had higher number 5 |
| 1w–28w | White Tri-square positions 1 thru 28 | WTR11w White TRIKER situated on tri-square position 11w |
| 1b–28b | BLACK Tri-square positions 1 thru 28 | BTX1w Black TRIPEX situated on tri-square position 1w |
| br | Border | Br1n Border position 1n |
| 1n–8n | Border Tri-square Positions 1n thru 8n | WTNbr8n White TRIPEEN positioned on Border tri-square 8n |
| + Followed by Piece Code | Player gain that particular piece | B − $10bk + BTR23b Black pays $10 to the bank to purchase a Black TRIKER and places it on tri-square 23b |
| − Followed by Piece Code | Player loses that particular piece | −WTS6w White loses a TRIMIS situated on tri-square position 6w |
| + Followed by $ amount | Player gains indicated dollar amount from the bank or opponent | B + $60bk Black gains $60 from the bank |
| − Followed by $ amount | Player loses indicated dollar amount from the bank or opponent | W − $20B White loses $20 to Black |
| − In between two different piece and position codes within a particular series | Player moves a piece from one position to another position | , BTN5w − 12b, Player moves Black TRIPEEN from position 5w to position 12b |
| ! | TRI is proclaimed | WTR19b!BTX10b White TRIKER on Position 19b threatens Black TRIPEX on position 10b with TRI, therefore TRIPEX must attempt escape |
| , | Breaks down a series of play step by step | W3 + 1, B6 + 2, B + $30bk, BTK20b, TK4b, 13b |

-continued

| CODE | MEANING | EXAMPLE |
|---|---|---|
| | within a particular round | white rolls 3 + 1 followed by Black roll of 6 + 2, B Gains $30 from the bank, Black move Black TRIKER from tri-square position 20b, bridges over black TRKER on position 4b and land on position 13b |
| ( ) | Codes inside parenthesis indicate a series of moves relating to an interruption due to defense or escape attempt | (W5 + 3( )) White rolls 5 + 3 in an TRIPEX escape attempt but could not move |
| x | Number following x is canceled out | x2, the 2s are canceled out |
| / | Exchange conquering piece for piece equaling value of the conquered home base position | $B – $40bkBTR/BTX1w Black pays bank $40 for exchange of the conquering TRIKER for a TRIPEX by landing on the TRIPEX home base position |
| c | Player sells piece(s) from capture to bank | –cBTR + $10bk Black sells captured TRIKER to the bank for $10 |
| p | Player sells piece(s) from off the board to bank | –pWTS + $30bk Black sells its TRIMIS from off the board to the bank for $30 |
| * * | Game over | *B* Game over B wins Game |

"TRI" Complete Game in Code:

B5+1, W4+2

1) B3+2, W4+1, BTR15b, TK20b, TR26b, br4n
2) B6+3, W5+3, B6 (––)
3) B2+1, W3+3, W+$60bk, WTS4w–19w, W4+3, WTK7w, TR12w, TK18w, TR25w, br5n, W–$10bk+WTRbr3n
4) W4+3, B3+1, W4, WTR12w, TK18w, TR25w, TKbr5n, –BTR25b
5) W4+2, B6+1, B7 (––)
6) B4+3, W6+5, BTK20b, TR26b, TRbr4n, –WTKbr5n
7) B5+2, W6+3, WTK18w, TR13w, TK9w, TR14w, TK20w, TR26w, –BTKbr5n
8) W6+2, B6+2, B–$10bk+TR20b
9) B4+1, W6+5, W11 ( )(–), B5, B–$20bk, BTK16b, TR11b, TK7b, TR12b, TK18b, –WTR25b
10) W6+5, B6+5, B–$10bk+BTR19b
11) B4+3, W5+1, BTK9b, TR13b, TK18b, TK25b, –WTKbr5n
12) B5+3, W2+2, BTR19b, TRbr4n, TKbr5n, –WTS19w
13) B5+3, W6+1, BTK18b, TKbr5n, TR19w, –WTK9w
14) B6+4, W5+4, B10 ( ), B–$40bk, W9 ( ), W–$40bk
15) B5+1, W4+1, B–$10bk, BTR27b, BTR20b, TR26b, TRbr4n, TK25b, TKbr5n, –WTR25w
16) B2+1, W4+2, B–$20bk, BTK9w, –WTN5w
17) B6+3, W5+4, BTR24b, TKbr5n, TR25w, 18w, B–$10bk/BTK18w
18) B4+2, W6+3, WTK16w, TR23w, TRbr3n, –BTR26b
19) W5+5, B2+1, B–$20bk, BTK5w! WTX1w, (W4+4( )), BTK5w, –WTX1w, B2+1, B–$20bk, BTKbr5n, TRbr4n, —WTK26b
20) B5+4, W5+3, W3, WTR27w, br6n, 24b, 18b, W–$10bk/WTK18b
21) W5+5, B4+4, W–$30bk, WTS6w–br8n
22) W5+3, B5+2, W3, WTR22w, TR23w, TR24w, –BTR25w
23) W4+2, B6+2, B8 ( )(–) W6, W4+2, W–$30bk, WTSbr8n–br2n, (B–$10bk, BTR4n, B3+2( )), WTSbr8n–br2n
24) B2+1, W2+1, W3, W–$20bk, WTK20w, br6n, 17b, –BTK7b, W3, W–$10bk, WTR23w, TRbr3n, TR24w, –BTRbr4n
25) W6+2, B4+4, B4, B8 (––)
26) B5+2, W6+2, W8 ( ), *B*

"TRI" Play by Play:

A single person orchestrates the battle between the black pieces (B) and the white pieces (W). The players agree upon an initial amount of $90 with each player receiving 1-$50, 1-$20 and 2-$10 bills from the bank. The two players receive a pair of corresponding colored dice. They roll their dice to see which player would be designated to roll his dice first to begin the first round of the game. B rolls 5+1 and W rolls 4+2. Although, B and W rolled the same total six, B is the designator since he rolled the higher number on a single die, which is 5. B designates himself to roll his dice first to begin the first round of the game. B rolls 3+2 and W follows with 4+1. B wins the round and having rolled a 3+(any number) combination, does not have to pay the bank to move his TRIKER 15*b* 3 tri-square positions by bridging TRIKER on 20*b* and TRIKER 26*b*, landing on border position 4*n*. B, having won the previous round, rolls 6+3 and W follows with 5+3. The matching 3s are cancelled out and B wins the round with the higher of the remaining numbers 6, but declines his move. B rolls 2+1 and W rolls 3+3. W, having rolled the special combination 3+3, receives $60 from the bank and moves his TRIMIS from position 4*w* to 19*w*. W also, gets an extra roll and rolls 4+3 and moves TRIBLK 7*w* 4 tri-squares by bridging TRIKER 12*w*, TRIBLK 18*w*, TRIKER 25*w*, and lands on border 5*n*. In addition, because of 3+3, w purchases a TRIKER and places it on border position 3*n*. W begins the next round with a roll of 4+3 and B follows with 3+1. The matching 3s are cancelled out and W wins with the higher of the remaining numbers 4. W moves his TRIKER from position 12*w* by bridging TRIBLK 18*w*, TRIKER 25*w*, TRIBLK on border position 5*n* and landing on and capturing black's TRIKER on 25*b*. W rolls 4+2 and B follows with 6+1. B wins the round with the higher total, but declines move. B begins round six with 4+3 and W rolls 6+5. Since B rolled a 3+(any number) combination, B wins round and does not have to pay the bank to move his TRIBLK situated on 20*b* 3 tri-square positions by bridging TRIKER 26*b*, TRIKER on border 4*n* and landing on and capturing W's TRIBLK on border 5*n*. B rolls 5+2 and W rolls 6+3. w wins the round with a 3+(any number) combination and does not have to pay the bank to move his TRIBLK 18*w* by bridging TRIKER 13*w*, TRIBLK 9*w*, TRIKER 14*w*, TRIBLK 20*w*, TRIKER 26*w* and landing on and capturing B's TRIBLK on border 5*n*. W begins next round with 6+2 and B follows with a duplicate 6+2. B rolled the duplicate and B gets to purchase a TRIKER from the bank for $10 and places it onto tri-square position 20*b*. Since B rolled the duplicate, B won the round and rolls first to begin a new round by rolling 4+1. W follows with a roll of 6+5. W cannot move 11 and passes play to B's 4+1 combination. B pays the bank $20 to move his TRIBLK 16*b* by bridging TRIKER 11*b*, TRIBLK 7*b*, TRIKER 12*b*, TRIBLK 18*b* landing on and capturing W's TRIKER 25*b*. Although B moved during the previous round, W won the round with the higher total of 11; therefore W rolls first to begin the new round by rolling 6+5 and B follows with a duplicate 6+5. Due to the duplicate B purchases a TRIKER from the bank for $10 and places it on position 19*b*. B, winning the round, rolls first to begin round 11 and rolls 4+3 and W follows with 5+1. B gets a free move and moves its TRIBLK 9*b* 4 tri-square positions by bridging TRIKER 13*b*, TRIBLK18*b*, TRIBLK25*b* and capturing W's TRIBLK on border 5*n*. B rolls 5+3 and W rolls 2+2 in next round. B wins and moves his TRIKER from 19*b* bridging TRIKER border 4*n*, TRIBLK border 5*n* and landing on 19*w* capturing W's TRIMIS. B begins round with 5+3. W rolls 6+1. B does not have to pay to move his TRIBLK from 18*b* by bridging TRIBLK border 5*n*, by bridging TRIKER 19*w*, landing on, and capturing a white's TRIBLK on 9*w*. B rolls 6+4 and W rolls 5+4. B cannot move 10 nor can W move 9, therefore each player must pay the bank the monetary equivalent of the lower number on either player's dice, which is 4×$10=$40. B having the higher of the totals rolls his dice to begin a new round and rolls 5+1. W follows with 4+1. B having the higher total pays the bank $10 to move his TRIKER from 27*b* by bridging TRIKER 20*b*, TRIKER 26*b*, TRIKER border 4*n*, TRIBLK 25*b*, TRIBLK border 5*n* and landing on and capturing W's TRIKER on 25*w*. B begins round 16 with a special combination 2+1; W rolls 4+2. B wins the round with the special 2+1 combination and pays the bank $20 to move his TRIBLK one position from 9*w* capturing W's TRIPEEN on 5*w*. B rolls 6+3 and W rolls 5+4. B moves his TRIKER 24*b* by bridging TRIBLK border 5*n*, TRIKER 25*w* and lands on tri-square 18*w*. By landing on W's TRIBLK home base position, he pays $10 to the bank to exchange the TRIKER for a TRIBLK. He places the exchanged piece on position 18*w*. B rolls 4+2 and W rolls 6+3. W moves it TRIBLK 16*w* three positions by bridging TRIKER 23*w* and TRIKER border 3*n* landing on and capturing B's TRIKER 26*b*. W rolls 5+5 and B rolls 2+1. B wins the round with a special 2+1 combination. B decides to move one tri-square position and pays the bank $20 to threaten W's TRIPEX that's situated on 1*w* by proclaiming "TRI". W rolls 4+4 in an escape attempt but could not hinder the threat. B moves its TRIBLK from 5*w* and captures W's TRIPEX on 1*w*. Since W had a free roll in an escape attempt, B gets to roll again and rolls 2+1. B pays the bank $20 to move his TRIBLK border 5*n* two tri-square positions by bridging TRIKER border 4*n* and landing on and capturing W' TRIBLK 26*b*. B, having won the round, rolls again to start a new round with 5+4 and W follows with 5+3. The matching 5's are canceled out because a 3+(any number) combination was rolled. W moves his TRIKER 27*w* three tri-square positions across border 6*n*, tri-square 24*b* and landing on B's TRIBLK home base position. By doing so, W gets to exchange its conquering TRIKER for a playing piece valued the same as the value of the conquered home base position. Therefore, W pays the bank $10 to exchange his TRIKER for a TRIBLK and places onto position 18*b*. Round twenty-one begins with White rolling 5+5 and Black rolling 4+4. White pays the banker $30 to fire or move his TRIMIS from 6*w* to border 8*n*. White rolls 5+3 and B follows with 5+2. The matching 5's are canceled out and W moves his TRIKER three tri-square positions from 22*w* by bridging TRIKER 23*w*, TRIKER 24*w* and landing on 25*w* capturing B's TRIKER. W starts a new round with 4+2 and B rolls 6+2; B cannot move 8 and passes to W's 4+2. W pays the bank $30 to fire his TRIMIS from border 8*n* to border 2*n*. B has a defending TRIKER in the firing path and pays the bank $10 to rolls once to defend against the firing TRIMIS. B rolls 3+2 and fails to shoot down the TRIMIS; therefore, W fires his TRIMIS from border 8*n* to border 2*n*. B, having won the previous round, rolls first to begin a new round and rolls 2+1. W follows with a duplicate of B's 2+1. W decides to pay the bank $20 to move his TRIBLK three tri-square position from 20*w*, across border 6*n*, tri-square 17*b*, and landing on and capturing B's TRIBLK on 7*b*. With an extra move due to duplicating the first player's 2+1, W move another piece three position after paying the bank $10 to move his TRIKER 23*w* by bridging TRIKER border 3*n*, TRIKER 24*w*, and capturing B's TRIKER on border 4*n*. W rolls 6+2 and B follows with 4+4. B wins with a double number in an equal totals situation and declines a move of four or eight tri-square positions. B rolls 5+2 and W rolls 6+2 to begin the final round. W wins the round with the higher combination of 8 but cannot move, therefore B wins the game.

"TRIPOINTS" POINTS TOTALED BY PIECE POSITION

| B (BLACK) | | | W (WHITE) | | |
|---|---|---|---|---|---|
| PIECE | POSITION | POINTS | PIECE | POSITION | POINTS |
| TRIPEX = 5 | 1b | 5 | TRIKER = 1 | 11w | 1 |
| TRIPEEN = 4 | 5b | 4 | TRIKER = 1 | 13w | 1 |
| TRIMIS = 3 | 4b | 3 | TRIKER = 1 | 14w | 1 |
| TRIMIS = 3 | 6b | 3 | TRIKER = 1 | 24w | 1 |
| TRIKER = 1 | 11b | 1 | TRIKER = 1 | 25w | 1 |
| TRIKER = 1 | 12b | 1 | TRIKER = 1 | 23w | 1 |
| TRIKER = 1 | 13b | 1 | TRIKER = 1 | 26w | 1 |
| TRIKER = 1 | 14b | 1 | TRIKER = 1 | 28w | 1 |
| TRIKER = 1 | 20b | 1 | TRIMIS = 3 | br2n | 3 |
| TRIKER = 1 | 22b | 1 | TRIKER = 1 | br3n | 1 |
| TRIBLK = 2 | 23b | 2 | TRIKER = 1 | br4n | 1 |
| TRIBLK = 2 | 25b | 2 | TRIBLK = 2 | 18b | 4 |
| TRIKER = 1 | 28b | 1 | TRIBLK = 2 | 7b | 4 |
| TRIKER = 1 | 19w | 1 | | TOTAL | 21 |
| TRIBLK = 2 | 18w | 4 | | | |
| TRIBLK = 2 | 1w | 7 | | | |
| | TOTAL | 38 | | | |

I claim:

1. A board game apparatus for at least one player comprising:

a substantially square board configuration, of plural tri-squares, having four corners and a diagonal border row of uniform tri-squares extending between two corners;

player positions are defined by other two corners of the board;

the board is divided into two equal triangular sections by said border row;

a first one of said two equal triangular sections has a pattern of hue;

the other of said two equal triangular sections has a pattern of hue converse to that of the first triangular section;

the border row is further defined by tri-squares of a distinctly different hue than that of other tri-squares;

different number-letter means marked on each tri-square on each of said two triangular sections of said board to establish assigned board positions for said tri-squares on said two triangular sections;

said number-letter means used in code to track game-piece movement on said board;

home base positions on select tri-squares;

home base position numbers marked on said select tri-squares to establish an assigned point value on the board for game pieces located in said home base positions whereby each game piece is located according to its assigned point value in its home base position; Said home base position numbers marked on said board range in point value from 1-5;

the highest point value of said range marked at said other two corners of said board;

another number-letter means assigned to said border tri-squares;

and said another number-letter means used in code to track game-piece movement on said board.

2. The board game apparatus as defined in claim 1 further comprising: chance element means for initiation of game play and subsequent play;

and money means allocated for said play.

3. The board game apparatus as defined in claim 1, further comprising:

bank container means for game play;

said bank container means is compartmentalized to secure different denominations of money and to hold game pieces.

4. The board game apparatus as defined in claim 1, further comprising:

The combination of board means and set marking card means to record rounds of play.

5. The board game apparatus as defined in claim 1, further comprising:

Rows of black tri-squares perpendicular to the border row and located on one side of said border row; and said black tri-squares are in line with rows of white tri-squares perpendicular to the border row and located on the other side of said border row.

6. The board game apparatus as defined in claim 5, further comprising:

Where one of said two equal triangular sections has a black tri-square apex which designates the side of the board where black game pieces are mounted;

and the other of said two equal triangular sections has a white tri-square apex which designates the side of the board where white game pieces are mounted.

* * * * *